United States Patent [19]

Kothmann et al.

[11] Patent Number: 4,626,129

[45] Date of Patent: Dec. 2, 1986

[54] SUB-SOIL DRAINAGE PIPING

[75] Inventors: Antonius B. Kothmann, No. 4 Haarhoff Street, Somerset West; Keith Brinch, Durbanville, both of South Africa

[73] Assignee: Antonius B. Kothman, Somerset West, South Africa

[21] Appl. No.: 634,485

[22] Filed: Jul. 26, 1984

[30] Foreign Application Priority Data

Jul. 27, 1983 [ZA] South Africa ..... 83/5499
Dec. 29, 1983 [ZA] South Africa ..... 83/9708

[51] Int. Cl.[4] ..... E02B 11/00; E02B 13/00

[52] U.S. Cl. ..... 405/43; 405/36; 405/45

[58] Field of Search ..... 405/43, 36, 38, 45, 405/39, 46–49

[56] References Cited

U.S. PATENT DOCUMENTS

| | | | |
|---|---|---|---|
| 1,406,182 | 2/1922 | Funk | 405/43 |
| 2,009,163 | 7/1935 | Chesley | 405/43 |
| 2,054,703 | 9/1936 | Little et al. | 405/43 |
| 2,143,072 | 1/1939 | Johnson | 405/43 X |
| 2,874,844 | 2/1959 | Wanner | 405/43 X |
| 3,902,322 | 9/1975 | Watanabe | 405/43 |
| 3,902,323 | 9/1975 | Watanabe | 405/43 |
| 4,134,268 | 1/1979 | Elmore | 405/43 |

FOREIGN PATENT DOCUMENTS

| | | | |
|---|---|---|---|
| 714459 | 11/1941 | Fed. Rep. of Germany | 405/43 |

*Primary Examiner*—Dennis L. Taylor
*Attorney, Agent, or Firm*—Holman & Stern

[57] ABSTRACT

A sub-soil drainage pipe segment 12 comprises a first round cylindrical portion 14 forming a socket 16 and a second round cylindrical portion 18 integral with and extending from the first portion, the inside diameter of the first portion being substantially equal to the outside diameter of the second portion. In the second portion there are a plurality of circumferentially spaced, longitudinally extending slots 22. The slots are defined by longitudinally extending side walls which diverge from the outside inwardly. A plain end 20 of the second portion forms a spigot which is receivable in the socket of a similar segment, so that a number of such segments can be interconnected end-to-end to form a sub-soil drainage line.

3 Claims, 4 Drawing Figures

SUB-SOIL DRAINAGE PIPING

FIELD OF THE INVENTION

This invention relates to sub-soil drainage piping. More particularly, it relates to a sub-soil drainage pipe segment, and to a sub-soil drainage line made up of a number of such segments.

BACKGROUND TO THE INVENTION

Clay pipe segments, pitch-fibre pipes, and extruded plastics pipes have for many years been used in sub-soil drainage systems. In the systems making use of clay pipe segments, water-perviousness is provided by the porosity of the clay and by imperfect fitting of adjacent pipe segments. Although durable, clay pipes are expensive. In the pitch-fibre systems the pipes are drilled to render them water-pervious. In extruded plastics systems, the pipes are provided with transverse saw cuts to render them water-pervious. In both the pitch-fibre and extruded plastics systems, it is not possible readily to provide sufficiently narrow drill holes or saw cuts and this usually makes it necessary to provide a porous filler such as ash or gravel around the pipes during laying. This increases the labour cost. Furthermore, the drill holes and saw cuts are inevitably rough and of uniform width throughout the thickness of the pipe, leading to sand and other particles becoming lodged in the openings and clogging them up.

It is an object of the present invention to provide a relatively inexpensive sub-soil drainage pipe segment which will not suffer from the disadvantages set out above.

SUMMARY OF THE INVENTION

According to the invention there is provided a sub-soil drainage pipe segment which has connecting formations at opposite ends thereof, whereby a number of such segments can be interconnected end-to-end to form a sub-soil drainage line, the segment further having a plurality of circumferentially spaced, longitudinally extending slots therein which render the segment water-pervious.

The connecting formations may be complementary spigot and socket formations, whereby the spigot formation of one such pipe segment is receivable in a socket formed by the socket formation of another such pipe segment.

Each slot may, across its entire width and depth, be open longitudinally in the direction of the socket.

The pipe segment may comprise a first round cylindrical portion extending to one end of the pipe segment and forming the socket, and a second round cylindrical portion integral with and extending from the first cylindrical portion to the other end of the segment, the inside diameter of the first cylindrical portion being equal to or slightly greater than the outside diameter of the second cylindrical portion.

The length of the pipe segment is preferably less than twice the outside diameter of the second cylindrical portion.

Each slot may be defined by a pair of longitudinally extending walls which diverge from the outside of the segment inwardly.

The invention extends to a sub-soil drainage pipe segment which has a plurality of circumferentially spaced, longitudinally extending slots therein, each slot being defined by a pair of longitudinally extending walls which diverge from the outside of the segment inwardly.

The invention further extends to a sub-soil drainage line comprising a plurality of segments as defined above, connected together end-to-end.

The invention will now be described in more detail, by way of example, with reference to the accompanying drawings.

DETAILED DESCRIPTION OF PREFERRED EMBODIMENT

Figure 1:
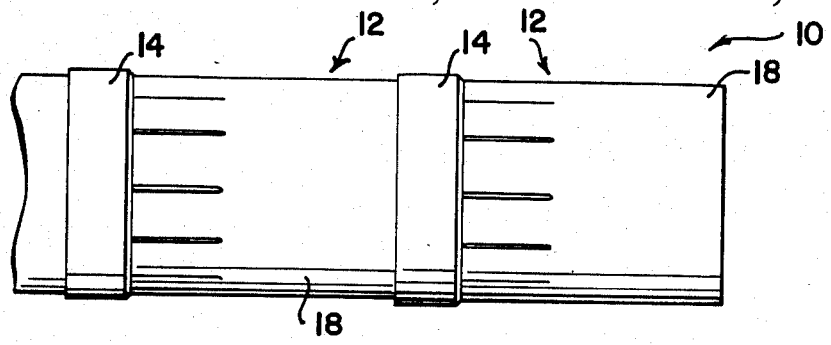
FIG. 1 is a side view of a number of sub-soil drainingе pipe segments in accordance with the invention, the segments having been assembled to form a sub-soil drainage line.

Referring first to FIG. 1, reference numeral 10 generally indicates part of a sub-soil drainage line which is made up of a number of sub-soil pipe segments 12 assembled together in end-to-end fashion. The pipe segments are injection moulded from a suitable plastics material.

Figure 3:
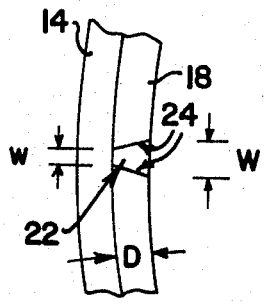
FIG. 3 is an enlargement of part of FIG. 3 (the part indicated at III)
Figure 2:
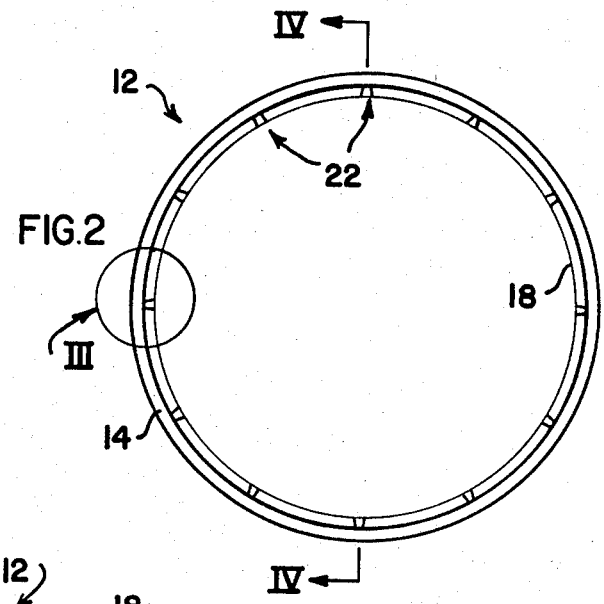
FIG. 2 is an end view (from the direction II in FIG. 3) of one of the pipe-segments.
Figure 4:
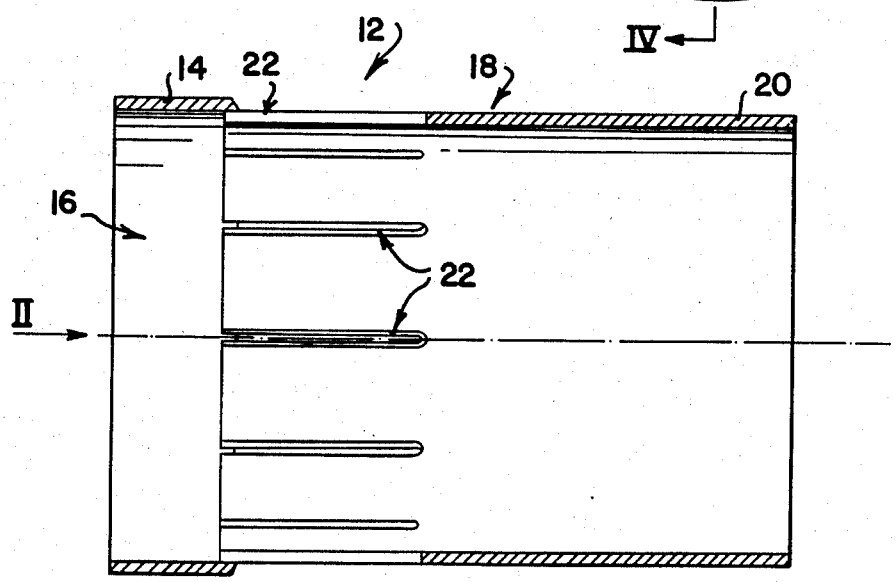
FIG. 4 is a longitudinal section of the pipe segment, taken on line IV—IV in FIG. 2.

Referring now to FIGS. 2 to 4, each pipe segment 12 comprises a first round cylindrical portion 14 which extends to one end of the pipe segment and defines a socket 16, and a second round cylindrical portion 18 integral with and extending from the first portion to the other end of the pipe segment. A plain end 20 of the portion 18 forms a spigot which is receivable in the socket 16 of a similar pipe segment, thus enabling a plurality of such pipe segments to be interconnected end-to-end as illustrated in FIG. 1. The outside diameter of the portion 18 is substantially equal to the inside diameter of the socket 16 so that the pipe segments are a tight fit, one into the other. In the portion 18 there are a plurality of circumferentially spaced, longitudinally extending slots 22 which render the pipe segment water-pervious.

Each slot 22 is defined by a pair of longitudinally extending side walls 24 which deverge from the outside of the pipe segment inwardly. Width w of the slots 22 at the outside of the portion 18 is in the order of 0.6 mm, and width at the inside in the order of 1.5 mm. The depth D of the slots 22 (i.e. the wall thickness of the portion 18) is in the order of 1.5 mm. The outside diameter of the portion 18 is in the order of 70 to 80 mm and the length of the segments is roughly 30% greater than the outside diameter of the portion 18. It will be appreciated that these dimensions are given purely by way of example and are in no way intended to limit the scope of the invention.

Each slot 22, across its entire depth and width, is open longitudinally in the direction of the socket 16. This enables the pipe segment 12 to be produced in a single injection moulding cycle without the need for collapsible cores. Thus, a mould for producing the pipe segment 12 may have an outer part and a core. The outer part of the mould will have a first portion of small diameter corresponding to the outside diameter of the portion 18, and a second portion of large diameter corresponding to the outside diameter of the portion 14. The core will have a first portion of small diameter corresponding to the inside diameter of the portion 18, a second portion of large diameter corresponding to the diameter of the socket 16, and a number of circumferentially spaced ridges protruding radially outwardly from the first portion of the core and extending longitudinally from the second portion of the core, each ridge corresponding to a respective one of the slots 22. When the two parts of the mould are closed, the ridges will touch the first portion of the outer part of the mould. It will be clear that in the construction illustrated, it will be possible to remove a moulded pipe segment 12 longitudinally from the core without the core having to be collapsible.

By producing the pipe segments by injection moulding in this manner, the slots 22 can be provided with very smooth side walls 24. This, in addition to the inwardly diverging construction of the slots will minimise the tendency to clog. It is also possible, in this manner, to provide slots having a width w which is substantailly less than that which can conveniently be produced by drilling or sawing.

If desired, the mould be of the multiple core type so that two or more pipe segments 12 can be produced simultaneously in a single moulding cycle. In this event the mould may be such that two or more pipe segments of progressively decreasing diameter can be produced simultaneously, the diameters being chosen such that the pipe segments produced during each injection moulding cycle can be nested one in the other. This will substantially reduce space requirements for packaging and transportation purposes. In assembling a drainage line from such segments of differing diameter, a first part may be assembled from a number of pipe segments of the smallest diameter, followed by a second part assembled from a number of pipe segments of the next greater diameter, and so on. The fact that two adjacent pipe segments of differing diameter will have a certain amount of clearance between them will not matter as water seepage is desired rather than to be avoided.

Although the pipe segments 12 can be fitted together manually, they lend themselves particularly to mechanised fitting together and laying. This may, for example, be achieved by providing a trench-digging machine with a guide tube through which the pipe segments can be guided into the trench immediately after it has been dug by the trench-digging machine. At the mouth of the tube there may be a loading bay into which pipe segments can be loaded, and a reciprocating mechanism, which may operate mechanicaly or hydraulically, for pressing each pipe segment into engagement with the pipe segment that precedes it.

If desired, adjacent pipe segments may be secured together adhesively, e.g. by means of applying a small amount of suitable solvent to the interengaging spigot and socket formations.

We claim:

1. A sub-soil drainage pipe segment which has connecting formations at opposite ends thereof, whereby a number of such segments can be interconnected end-to-end to form a sub-soil drainage line, the segment further having a plurality of circumferentially spaced, longitudinally extending slots therein which render the segment water-pervious, wherein the connecting formations are complementary spigot and socket formations, whereby the spigot formation of one such pipe segment is receivable in a socket formed by the socket formation of another such pipe segment, wherein each slot, across its entire width and depth, opens into the socket at one end of the slot and wherein the pipe segment comprises a first round cylindrical portion extending to one end of the pipe segment and forming the socket, and a second round cylindrical portion integral with and extending from the first cylindrical portion to the other end of the segment, the inside diameter of the first cylindrical portion being equal to or slightly greater that the outside diameter of the second cylindrical portion.

2. A sub-soil drainage pipe segment as claimed in claim 1, wherein the length of the pipe segment is less than twice the outside diameter of the second cylindrical portion.

3. A sub-soil drainage pipe segment according to claim 1, wherein each slot is defined by a pair of longitudinally extending walls which diverge from the outside of the segment inwardly.

* * * * *